United States Patent [19]

August et al.

[11] Patent Number: 4,911,645

[45] Date of Patent: Mar. 27, 1990

[54] PARALLEL BOARD ZIF MODULE CONNECTOR

[75] Inventors: Melvin C. August; Eugene F. Neumann, both of Chippewa Falls, Wis.

[73] Assignee: Cray Research, Inc., Minneapolis, Minn.

[21] Appl. No.: 284,905

[22] Filed: Dec. 14, 1988

[51] Int. Cl.[4] ..... H01R 9/09

[52] U.S. Cl. ..... 439/75; 439/82; 439/262; 439/380

[58] Field of Search ..... 439/75, 81, 82, 84, 439/45, 50, 51, 262, 263, 265, 380, 581

[56] References Cited

U.S. PATENT DOCUMENTS

| | | | |
|---|---|---|---|
| 3,333,225 | 7/1967 | McNutt | 439/75 |
| 3,459,998 | 8/1969 | Focarile | 317/100 |
| 3,537,063 | 10/1970 | Beaulieu | 339/74 |
| 3,541,494 | 11/1970 | Berg | 339/75 |
| 3,793,609 | 2/1974 | Mciver | 339/74 R |
| 3,899,234 | 8/1975 | Yeager et al. | 339/74 |
| 3,977,747 | 8/1976 | Broutros | 339/74 R |
| 3,982,807 | 9/1976 | Anhault et al. | 339/75 MP |
| 4,220,382 | 9/1980 | Ritchie et al. | 339/17 LM |
| 4,261,631 | 4/1981 | Guilcher et al. | 339/75 MP |
| 4,272,143 | 6/1981 | Weiss | 339/74 R |
| 4,392,700 | 7/1983 | Shoman et al. | 339/17 M |
| 4,514,784 | 4/1985 | Williams et al. | 339/17 M |
| 4,700,996 | 10/1987 | August et al. | 439/268 |
| 4,813,128 | 3/1989 | Massopust | 439/875 |

*Primary Examiner*—P. Austin Bradley

*Attorney, Agent, or Firm*—Merchant, Gould, Smith, Edell, Welter & Schmidt

[57] ABSTRACT

The present invention provides a parallel board connector having zero insertion force between a PC board and a backplane which presents effectively zero impedance change through the connector interface. The PC board and the backplane to which it is to be connected have through-plated holes. The boards are positioned to overlap such that the through-plated holes are axially aligned. A shuttle block is provided with a number of parallel dual flex pins attached to one surface. To effect connection, the flex pins of the shuttle block are inserted through the holes of one board and into the holes of a second board to provide an electrical connection having very low or no impedance interface.

9 Claims, 2 Drawing Sheets

PARALLEL BOARD ZIF MODULE CONNECTOR

FIELD OF THE INVENTION

This invention pertains to the field of printed circuit board connectors and in particular to zero insertion force (ZIF) connectors.

BACKGROUND

Many prior art printed circuit board connectors are constructed so that the pins on a connector lie at the edge of the board. The pc board typically contains the logic chips and is often called a daughter board. The daughter board plugs into a board called a mother board or the backplane which receives a plurality of daughter boards. The mother board has sockets aligned to receive the edge connectors on the daughter board. The mother board is typically positioned in a plane perpendicular to the plane of the daughter boards and provides the power and signal connections between the daughter boards.

As computers became more sophisticated, it became desirous to increase the number of pins on each edge connector between each daughter board and mother board. To minimally affect the spacing between boards connected to a backplane, the pins were reduced in size to increase packing density on each edge connector. However, as the pin size decreases, the electrical impedance of the pin increases, therefore, due to minimum current handling requirements, there is a lower limit to the pin size. Consequently, it became necessary to increase the number of pins on each edge connector by a method other than decreasing the pin size.

One prior art technique to increase the number of edge pins is to align a second set of pins parallel to the first set of pins but separated by a small distance; i.e., the added row of pins are raised off the face of the daughter board, but parallel to the board. The mother board has a parallel set of receptors aligned to receive the second set of pins. As the number of pins required increases, additional rows may be added. However, the number of rows of pins that may be added is limited by the amount of space between daughter boards. The plane of each daughter board is usually parallel to the plane of every other daughter board. Thus, as the number of rows of edge pins is increased, the space between daughter boards must be increased to accommodate the additional connector spacing requirements. However, the spacing between daughter boards must be kept to a minimum to minimize the electrical path lengths between logic components and thereby minimize signal propagation delay. Therefore, it is not practical to continue increasing the size of the mother board and increasing the spacing between daughter boards.

Many prior art edge pin connectors typically require a small, but finite amount of force to insert each pin. In super-computers such as the type manufactured by the assignee of the present invention, the daughter boards require many pin connections, and so it is important to employ a connector which allows the board to be inserted with zero insertion force since, if a pin has a non-zero insertion force the total insertion force for a board having thousands of pins becomes prohibitive.

High-speed computers require connectors that have minimal impedance interfaces (impedance changes through the connector) because an impedance interface may cause a partial reflection of a transmitted signal along an electrical path. This causes a cancelling voltage to be seen at the transmitter and a reduced voltage seen at the receiver. If the reflection is severe the receiver may not receive the proper signal and a transient fault would occur. In super-computers operating at a high frequency it is extremely important to minimize or avoid impedance interfaces because the magnitude of the reflected wave is frequency dependent. Since impedance itself is frequency dependent, the magnitude of a reflected wave at an impedance interface changes as frequency increases. An impedance interface that is acceptable at a low frequency may cause an error in data transmission at a higher frequency. As a result, data dependent errors may be caused by impedance interfaces depending upon the effective frequency of data transmitted through the interface. If the data consists of a one followed by several zeroes followed by a one, the effective frequency for impedance and reflection purposes will be lower than the peak operating frequency. If the data consists of alternating ones and zeros, the effective frequency for impedance and reflection purposes will be the peak operating frequency of the computer. Thus, an impedance change or mismatch at a connector interface may cause an error in data transmission for only some data.

Thus, there is a need in the prior art for high density edge connections between pc boars and backplanes which allows a high packing density of pins and yet does not increase the overall spacing between the pc boards on the backplane. There is also a need in the prior art for a high density edge connection scheme which allows boards to be placed and interconnected to the backplane with zero insertion force. There is also a need in the prior art to provide a very short electrical path between the PC boards and the backplane. There is also a need in the prior art for a high density pin edge connection scheme that imposes a minimum of impedance mismatching at the connector interface so that the electrical path between a signal transmitter and a signal receiver passing through the backplane is not subject to signal reflections due to impedance mismatches.

SUMMARY OF THE INVENTION

To alleviate the problems of the prior art indicated above and to provide other advantages and benefits which will be readily recognized to those skilled in the art upon reading and understanding the present specification, the present invention provides a parallel board connector providing zero insertion force between the pc boards and the backplane and which present effectively no impedance change through the connector interface. The present invention has a number f parallel dual flex pins affixed to ne surface of a shuttle block. A first circuit board, typically called the daughter board, has a plurality of plated-through holes with surface or buried traces connecting the logic chips of the first circuit board to the plated holes. A second circuit board, typically called the connector board, also has a plurality of plated-through holes and is connected to a backplane, mother board, or to wired inter-board connections. The holes are positioned such that when the first and second boards are aligned properly the longitudinal axis of each plated-through holes on the first circuit board is co-linear with the longitudinal axis of a plated-through hole on the second circuit board. The circuit boards may be aligned using aligning holes and an aligning pin.

The daughter board and the shuttle block are positioned so that the first half of each dual flex pin is inserted into the plated-through holes o the daughter board. The daughter board and connector board are then aligned and, if one is used, the aligning pin is inserted. After the aligning pin is inserted, a cam engages the shuttle block to push it towards the daughter board. This causes the second half of dual flex pins to be inserted through the plated-through holes on the daughter board and first half flex pins into the plated-through holes on the connector board so that the second half of each pin is inserted through a plated-through hole of the daughter board and the first half of each pin is inserted into a plated-through hole of the connector board. The shuttle block typically has spacers to prevent the shuttle block from actually contacting the daughter board. This type of arrangement provides for a zero insertion force connector having effectively no impedance interface.

An alternative embodiment provides two opposing shuttle blocks, each having pins affixed to one surface such that when the shuttle blocks are adjacent the pins on each shuttle block are on opposite faces. Two pairs of circuit boards are provided, one pair positioned to receive the pins affixed to each shuttle block. The cam causes both shuttle blocks to move toward the appropriate circuit board; thereby connecting each daughter board to the appropriate connector board.

DETAILED DESCRIPTION OF THE PREFERRED EMBODIMENT

The following detailed description of the preferred embodiment, references made to the accompanying drawings which form a part hereof and in which is shown by way of illustration a specific embodiment in which the invention my be practiced. This embodiment is described in sufficient detail to enable those skilled in the art to practice the invention and it is to be understood that other embodiments may be utilized and that structural or electrical changes may be made without departing from the scope of the present invention. The following detailed description is therefore not to e taken in a limiting sense and the scope of the present invention is defined by the appended claims.

Figure 1:
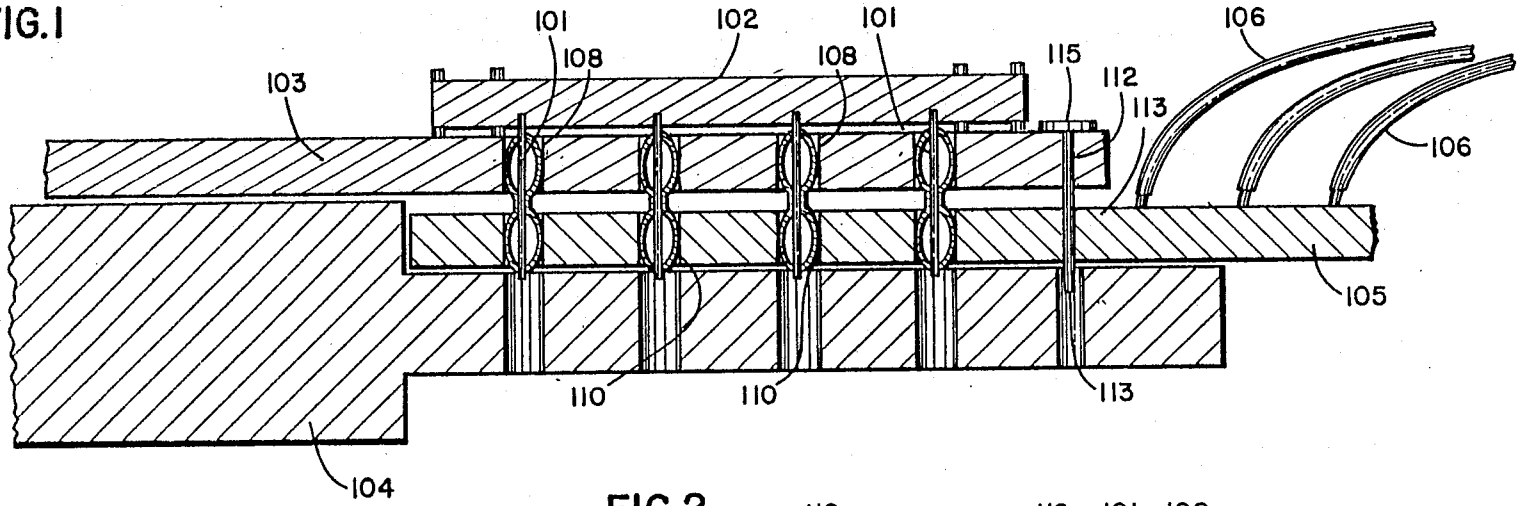
FIG. 1 is a cross-sectional view of a connector board connected to a pc board by dual flex pins.

Referring to the drawings wherein like numerals refer to like parts and to FIG. 1 in particular, a zero insertion force parallel board connector having little or no impedance interface is shown in the side view in an engaged position. In the preferred embodiment dual flex pins 101 are perpendicularly affixed to shuttle block 102. Dual flex pins 101 are resilient and have zero insertion force. Examples of these types of pins are the micro or nano stamped contact from Cannon, TRW, Omnetics, or Ultimate. Dual flex pins 101 are first inserted through plated-through holes 108 of pc board 103 and into plated-through holes 110 of connector board 105. Aligning pin hole 112 of pc board 103 and aligning pin hole 113 of connector board 105 are positioned to receive aligning pin 115. When several aligning pins are used there is only one possible orientation of the pc board relative to the connector board, thereby ensuring that plated-through holes 108 and 110 are co-linear. Optional cold plate 104 is attached to connector board 105 or pc board 103 or both to conduct heat away from connector board 105 and pc board 103. External wires 106 are attached to connector board 105.

External wires 106 are coax or twisted pair wires chosen such that the impedance in the preferred embodiment is 60 ohms External wires 106 are connected to plated-through holes 110 of connector board 105 by traces on connector board 105. Dual flex pins 10 are chosen such that the impedance of dual flex pins 101 remains 60 ohms across the interface so as to match the impedance of the traces on connector board 105 and the external wires 106. The traces on daughter board 103 also conform to 60 ohm impedance. This provides uniform impedance across the interface wherein there is no impedance mismatch or change in impedance through connector board 105 or through pins 101. As known to those skilled in the art, twisted pair wires 106 may be replaced with coaxial cables or the connector board may be directly connected to a backplane without changing the scope of the invention.

The size of plated-through holes 110 on connector board 105 and plated-through holes 108 on pc board 103 must be precisely controlled to ensure that dual flex pins 101 may be inserted without losing contact. The plating on plated-through holes 110 and 108 must also be precisely controlled to ensure that a proper connection with pins 101 is maintained and that before pins 101 are inserted, the boards may be inserted or aligned with zero insertion force. To ensure hole size accuracy, the holes may be first plated and then reamed.

Figure 2:
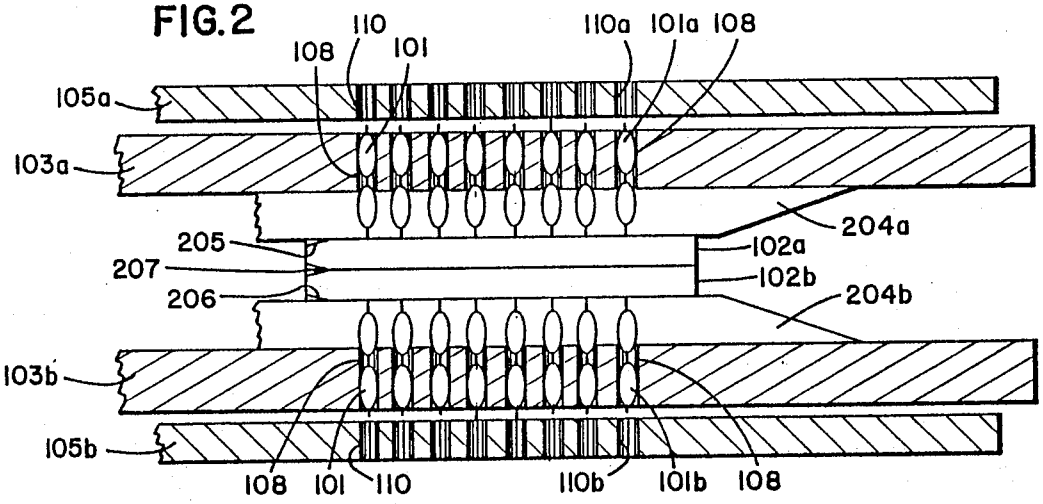
FIG. 2 is a cross-sectional view of two opposing shuttle blocks having dual flex pins in a disengaged position.

FIG. 2 shows, in a side view, an alternative embodiment having two shuttle blocks in which the shuttle blocks are in a disengaged positions. The reference numbers correspond to the elements of FIG. 1 wherein the "a" and "b" suffixes designate the upper and lower parallel board ZIF module connector. Shuttle blocks 102*a* and 102*b* have dual flex pins 101 affixed to opposite surfaces. The pins have been inserted into plated-through holes 108, in pc boards 103. Wired connector boards 105 have been moved into position to receive the aligning pins. Cams 204*a* and 204*b* have engaged shuttle blocks 102*a* and 102*b*, withdrawing pins 101*a* and 101*b* from plated-through holes 110*a* and 110*b* of connector boards 105*a* and 105*b*. Cam 204*a* engaged shuttle block 102*a* at wedge shaped recess 205. Similarly, Cam 204*b* engaged shuttle block 102*b* at wedge shaped recess 206. Wedge shape recess 207 is to force shuttle blocks 102*a* and 102*b* towards pc boards 103*a* and 103*b*.

Figure 3:
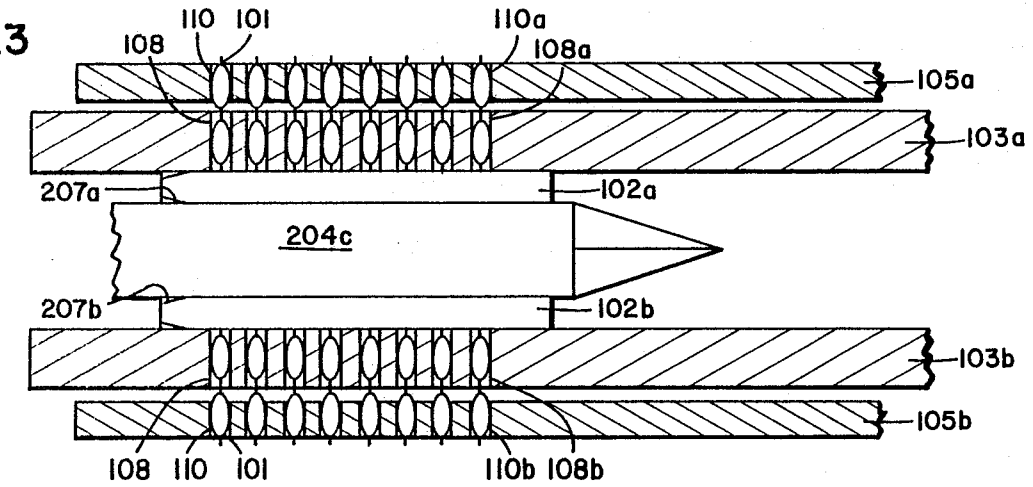
FIG. 3 is a cross-sectional view of two opposing shuttle blocks having dual flex pin in an engaged position which connects a pc board and a connector board.

FIG. 3 shows, in another side view, shuttle blocks 102*a* and 102*b*, connector boards 105*a* and 105*b*, and pc boards 103*a* and 103*b* after cam 204*c* has engaged shuttle blocks 102*a* and 102*b* at wedge shaped recesses 207*a* and 207*b*. Dual flex pins 101 have been inserted through plated-through holes 108*a* and 108*b* of pc boards 103*a* and 103*b* and into plated-through holes 110*a* and 110*b* of connector boards 105*a* and 105*b*, respectively, thereby electrically connecting each pc board to the appropriate connector board.

Figure 4:
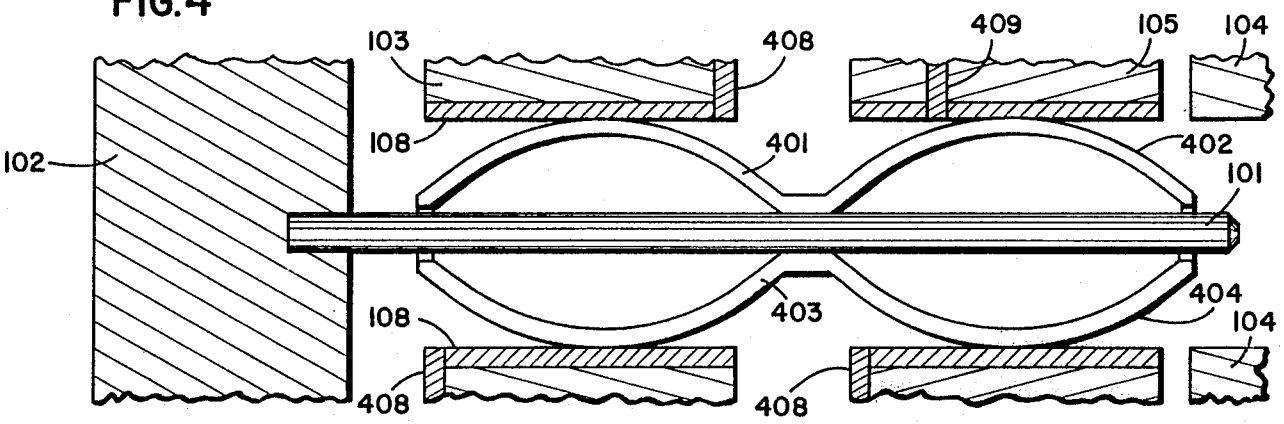
FIG. 4 is a detailed cross-sectional view of a dual flex pin.

FIG. 4 shows an expanded cross-sectional view of a dual flex pin 101. Engagement members 401 and 403 are inserted into plated-through hole 108 of pc board 103 and engagement members 402 and 404 are inserted into plated-through holes 110 of connector board 105. The plated through holes 108 and 110 connect to electrical circuitry through plated surface traces 408 or plated buried traces 409 on boards 103 and 105. It may be seen that engagement members 401–404 are affixed at the longitudinal center of pin 101 and are not affixed at the longitudinal extremes of pin 101. This pin design allows impedances to be precisely matched and has the advantages that because the daughter board is in very close proximity to the connector board, an extremely short electrical path can be achieved and the pins are internal to the boards and thus protected. When implementing the present invention it is important that the pin and the plated-through holes be made with very low tolerance.

Those skilled in the art will recognize that pins of other design may be used, provided that the pins provide a good connection from the connector board 105 to the pc board 103.

While the present invention has been described in connection with the preferred embodiment thereof, it will be understood that many modifications will be readily apparent to those of ordinary skill in the art, and this application is intended to cover any adaptations or variations thereof. Therefore, it is manifestly intended that this invention be limited only by the claims and the equivalents thereof.

What is claimed is:

1. A zero insertion force parallel board connector a minimal impedance interface comprising:

a first circuit board having a plurality of plated-through holes electrically connected to circuitry on said first circuit board a second circuit board having a plurality of plated-through holes electrically connected to circuitry on said second circuit board and aligned in parallel to said first second circuit board and align in parallel to said first circuit board such that said plurality of holes of said first circuit board is substantially axially aligned to said plurality of holes of said second circuit board;

a shuttle block having a plurality of resilient pins affixed to a surface of said shuttle block and aligned with said pluralities of holes on said first and second circuit boards; and a cam for engaging said shuttle block and for inserting said plurality of resilient pins through said plurality of plated-through holes on said first circuit board and into said plurality of plated-through holes on said second circuit board.

2. A connector according to claim 1 further including:

first aligning means for aligning said shuttle block and said first circuit board such that each of said resilient pins is received by one of said plated-through holes of said first circuit board; and second aligning means to align said first and said second circuit boards such that a longitudinal axis of each of said plated-through holes of said first circuit board is co-linear with a longitudinal axis of one of said plated-through holes of said second circuit board to define a pair of co-linear plated-through holes.

3. A connector according to claim 2 wherein said second aligning means includes at least one aligning pin and at least one aligning pin hole on said first and second circuit boards.

4. A zero insertion force parallel board connector having a minimal impedance interface comprising:

a first circuit board having a plurality of plated-through holes electrically connected to circuitry on said first circuit board;

a second circuit board having a plurality of plated-through holes electrically connected to circuitry on said second circuit board and aligned in parallel to said first circuit board such that said plurality of holes of said first circuit board is substantially axially aligned to said plurality of holes of said second circuit board;

a shuttle block having a plurality of resilient pins affixed to a surface of said shuttle block and aligned with said pluralities of holes on said first and second circuit boards;

cam means for engaging said shuttle block and for inserting said plurality of resilient pins through said plurality of plated-through holes on said first circuit board and into said plurality of plated-through holes on said second circuit board;

a third circuit board having a plurality of plated-through holes electrically connected to circuitry on said third circuit board;

a fourth circuit board having a plurality of plated-through holes electrically connected to circuitry on said fourth circuit board and aligned in parallel to said third circuit board such that said plurality of holes of said third circuit board is substantially axially aligned to said plurality of holes of said second circuit board;

a second shuttle block having a plurality of resilient pins affixed to a surface of said second shuttle block and aligned with said pluralities of holes on said third and fourth circuit boards; and wherein said cam means further engages said second shuttle block for inserting said plurality of resilient pins affixed to said surface of said second shuttle block through said plurality of plated-through holes on said third circuit board and into said plurality of plated-through holes on said fourth circuit board.

5. A connector according to claim 4 further including:

first aligning means for aligning said shuttle block and said first circuit board such that each of said resilient pins affixed to said shuttle block is received by one of said plated-through holes of said first circuit board;

second aligning means to align said first and said second circuit boards such that a longitudinal axis of each of said plated-through holes of said first circuit board is co-linear with a longitudinal axis of one of said plated-through holes of said second circuit board to define a pair of co-linear plated-through holes;

third aligning means for aligning said second shuttle block and said third circuit board such that each of said resilient pins affixed to said second shuttle block is received by one of said plated-through holes of said third circuit board; and fourth aligning means for aligning said third and fourth circuit boards such that a longitudinal axis of each of said plated-through holes of said third circuit board is co-linear with a longitudinal axis of one of said plated-through holes of said fourth circuit board to define a pair of co-linear plated-through holes.

6. A connector according to claim 5 wherein said second aligning means include at least one aligning pin and at least one aligning pin hole on said first and second circuit boards and said fourth aligning means includes at least one aligning pin and at least one aligning pin hole on said third and fourth circuit boards.

7. A method of connecting parallel circuit boards having a minimal impedance interface and an extremely short electrical path, comprising the steps of:

(a) aligning a shuttle block and a first circuit board;

(b) aligning a second circuit board in parallel with said first circuit board; and (c) engaging said shuttle block with a cam for inserting a plurality of pins affixed to said shuttle block through a plurality of plated-through holes electrically connected to circuitry on said first circuit board and into a plurality of plated-through holes on said second circuit board.

8. A method according to claim 7 wherein step (a) further includes the step of inserting an aligning pin into aligning pin holes on each of said first and second circuit boards.

9. A method of connecting parallel circuit boards having a minimal impedance interface and an extremely short electrical path, comprising the steps of:

(a) aligning a shuttle block and a first circuit board;

(b) inserting a plurality of pins affixed to said shuttle block into a plurality of plated-through holes electrically connected to circuitry on said first circuit board;

(c) aligning a second circuit board in parallel with said first circuit board;

(d) inserting each of said resilient pins into a plated-through hole on said second circuit board;

(e) aligning a second shuttle block and a third circuit board;

(f) inserting a plurality pins affixed to said second shuttle block into a plurality of plated-through holes electrically connected to circuitry on said third circuit board;

(g) aligning a fourth circuit board in parallel with said first circuit board;

(h) inserting each of said resilient pins into a plated-through hole on said third circuit board and through one of said plated-through holes on said fourth circuit board.

* * * * *